US009585460B2

(12) United States Patent
Wade et al.

(10) Patent No.: US 9,585,460 B2
(45) Date of Patent: Mar. 7, 2017

(54) SCREW-BASED DISPENSER HAVING LOCKING ELEVATOR AND ELEVATOR RETENTION MECHANISM

(71) Applicant: TUF-TITE, INC., Lake Zurich, IL (US)

(72) Inventors: Gordon D. Wade, Wauconda, IL (US); Greg McMurray, Des Plaines, IL (US); Wayne A. Huerth, Prairie Grove, IL (US)

(73) Assignee: TUF-TITE, INC., Lake Zurich, IL (US)

( * ) Notice: Subject to any disclaimer, the term of this patent is extended or adjusted under 35 U.S.C. 154(b) by 152 days.

(21) Appl. No.: 14/312,091

(22) Filed: Jun. 23, 2014

(65) Prior Publication Data

US 2015/0003885 A1 Jan. 1, 2015

Related U.S. Application Data

(60) Provisional application No. 61/839,556, filed on Jun. 26, 2013.

(51) Int. Cl.
*A45D 40/06* (2006.01)
*A45D 40/12* (2006.01)

(52) U.S. Cl.
CPC ..... *A45D 40/06* (2013.01); *A45D 40/12* (2013.01)

(58) Field of Classification Search
CPC combination set(s) only.
See application file for complete search history.

(56) References Cited

U.S. PATENT DOCUMENTS

| | | | |
|---|---|---|---|
| D55,880 | S | 7/1920 | Pajeau |
| 1,781,852 | A | 11/1930 | Lyhne |
| 1,783,754 | A | 12/1930 | Stepelton |
| 1,950,324 | A | 3/1934 | Powers |
| 2,816,309 | A | 12/1957 | Worth et al. |
| 2,872,034 | A | 2/1959 | Harris |

(Continued)

FOREIGN PATENT DOCUMENTS

| | | | |
|---|---|---|---|
| DE | 3118893 | A1 | 11/1982 |
| DE | 9103380 | U1 | 6/1991 |

(Continued)

OTHER PUBLICATIONS

Collection of photos and Applicant's CAD renderings of softlips® (by The Mentholatum Company) medicated lip balm applicator (on sale more than one year before Jun. 26, 2013).

*Primary Examiner* — David Walczak
(74) *Attorney, Agent, or Firm* — Marshall, Gerstein & Borun LLP

(57) ABSTRACT

A screw-based dispenser for the application of cosmetic products and other applicable gels, liquids, and solids. The screw-based dispenser may have one or more of the following features: a cylindrical outer casing having at least two diametrically opposed feedback struts, a threaded screw connected to a base that is rotatable relative to the cylindrical outer casing, an elevator retention mechanism, a movable elevator operably engaged with the threaded screw within the cylindrical outer casing, and an elevator locking mechanism providing resistance to spontaneous axial movement of the elevator toward an end of the threaded screw opposite the rotatable base.

3 Claims, 5 Drawing Sheets

(56) References Cited

U.S. PATENT DOCUMENTS

| | | | | |
|---|---|---|---|---|
| 3,810,700 | A | 5/1974 | Bryan | |
| 3,917,417 | A | 11/1975 | Lang | |
| 3,954,114 | A | 5/1976 | Ostrowsky et al. | |
| 4,066,315 | A * | 1/1978 | Arneson | H01R 13/622 439/311 |
| 4,369,158 | A | 1/1983 | Woodruff et al. | |
| 4,595,124 | A | 6/1986 | Duval et al. | |
| 4,605,330 | A | 8/1986 | Crowley et al. | |
| 4,621,935 | A | 11/1986 | Sussman | |
| 4,865,480 | A | 9/1989 | Reynolds et al. | |
| 5,025,960 | A * | 6/1991 | Seager | A45D 40/04 222/153.14 |
| 5,186,561 | A | 2/1993 | Ackermann et al. | |
| 5,547,302 | A | 8/1996 | Dornbusch et al. | |
| 5,568,989 | A | 10/1996 | Benguigui | |
| 5,827,002 | A | 10/1998 | Nakajima | |
| 5,842,802 | A | 12/1998 | Lang et al. | |
| 5,851,079 | A | 12/1998 | Horstman et al. | |
| 5,860,756 | A | 1/1999 | Fabrisi | |
| 5,947,621 | A | 9/1999 | Szekely | |
| 5,984,551 | A | 11/1999 | Kinney, Jr. | |
| 6,033,140 | A | 3/2000 | Peng Huang | |
| 6,039,483 | A | 3/2000 | Szekely | |
| 6,129,471 | A | 10/2000 | Lang | |
| 6,136,352 | A | 10/2000 | Silverstein et al. | |
| 6,241,408 | B1 | 6/2001 | Lang | |
| 6,557,563 | B2 | 5/2003 | Ohba | |
| 6,571,950 | B2 | 6/2003 | Finnigan | |
| 7,648,300 | B2 * | 1/2010 | Szekely | A45D 34/041 401/175 |
| 2005/0072801 | A1 | 4/2005 | Chadfield et al. | |
| 2006/0013640 | A1 | 1/2006 | Skakoon et al. | |
| 2009/0080963 | A1 | 3/2009 | Skakoon et al. | |

FOREIGN PATENT DOCUMENTS

| | | | |
|---|---|---|---|
| EP | 0387213 | A2 | 9/1990 |
| EP | 0676155 | A2 | 10/1995 |
| FR | 2622481 | A1 | 5/1989 |
| GB | 890683 | A | 3/1962 |
| GB | 2208417 | A | 3/1989 |
| GB | 2211081 | A | 6/1989 |
| JP | H09344 | A | 1/1997 |

* cited by examiner

SCREW-BASED DISPENSER HAVING LOCKING ELEVATOR AND ELEVATOR RETENTION MECHANISM

CROSS-REFERENCE TO RELATED APPLICATIONS

This is a non-provisional and claims the benefit of the filing date of U.S. Provisional Application No. 61/839,556, filed Jun. 26, 2013. U.S. Provisional Application No. 61/839,556 is hereby incorporated by reference.

FIELD OF THE DISCLOSURE

This disclosure relates generally to dispensers used for the propelling and repelling of applicable gels, liquids, and solids, and more specifically, to screw-based dispensers using movable elevators to propel and repel consumer products such as balms, creams, deodorants, anti-chafe gels, and other cosmetic products.

BACKGROUND

A variety of dispensers for the application of cosmetic products and other applicable gels, liquids, and solids are generally known and used by consumers. One type of conventional screw-based dispenser has a cylindrical outer casing filled with an applicable substance, such as lip balm, wherein the applicable substance is placed upon an axially movable elevator. The axially movable elevator is engaged with a screw contained within the cylindrical casing, and rotation of the screw within the cylindrical outer casing is controlled by a rotatable base adjacent to one of the ends of the cylindrical outer casing. When the base rotates the screw, the movable elevator axially progresses up or down along the thread of the screw within the cylindrical casing, causing the applicable substance to either be propelled or repelled depending upon the direction of rotation of the base.

One problem with the manufacture of such screw-based dispensers is the issue of "up-elevator." After the screw-based dispensers are molded, they are often transported to another facility to be filled with the applicable substance. During filling, the movable elevator needs to be disposed near the non-dispensing end of the cylindrical casing in order for the cylindrical casing to be fully filled with the applicable product. However, jostling of the empty dispensers during transportation can cause the movable elevator to travel up from the non-dispensing end of the cylindrical casing closest to the rotatable base to a higher position. Not only does the higher position of the elevator result in a screw-based dispenser being less than optimally filled, but the higher position of the elevator even more problematically causes the excess applicable product that would normally fill the dispenser to spill over onto the manufacturing equipment. Cleaning up the manufacturing equipment and locating the insufficiently filled dispenser wastes time and materials.

Another drawback to conventional screw-based dispensers is that they can be disassembled by rotating the movable elevator off the top of the screw. Yet another drawback to conventional screw-based dispensers is a lack of sensory feedback when turning the rotatable base, with the result that a user is unable to ascertain whether the applicable product has been propelled or repelled a sufficient distance by the movable elevator without visual verification. Another drawback is the issue of floating, wherein the rotatable base is unintentionally rotated due, for example, to contact between the rotatable base and a user's pocket, causing the applicable product to inadvertently be propelled.

The manner in which these and other drawbacks of conventional screw-based dispensers are overcome is described in more detail in the following sections of the present disclosure.

SUMMARY OF THE DISCLOSURE

A screw-based dispenser having a locking elevator includes a cylindrical outer casing, a screw connected to a rotatable base, a movable elevator, and an applicable product. The screw is contained within the cylindrical outer housing such that the rotatable base is adjacent to the non-dispensing end of the cylindrical outer housing, and the movable elevator is engaged with the screw within the cylindrical outer housing. The movable elevator travels axially along the screw within the cylindrical outer casing when the rotatable base is turned. The applicable product, which may be a gel, liquid, or solid, is contained within the cylindrical casing on top of the movable elevator when the screw-based dispenser is set upright on the rotatable base. By turning the rotatable base a first direction, a user propels the elevator to expose a desired quantity of the applicable product at the top end of the cylindrical casing so that it may be applied. By turning the rotatable base a second direction, the user repels the applicable product back into the cylindrical casing so that it may be stored.

The turning of the rotatable base creates a clicking noise and tactile sensation due to diametrically opposed feedback flaps disposed on the lower portion of the screw coming into contact with diametrically opposed feedback struts disposed on the non-dispensing end of the cylindrical outer casing. The fact that the feedback flaps are diametrically opposed to one another and the feedback struts are also diametrically opposed to one another is significant as it ensures that at least two feedback flaps come into contact with at least two feedback struts when contact between the feedback flaps and feedback struts occurs. This ensures that the noise generated by the contact is loud enough for a user to hear and the pressure generated by the contact is significant enough for a user to feel when turning the rotatable base. Additionally, the force required to overcome the resistance created between the feedback flaps and feedback struts is sufficient to prevent unintentional rotation of the rotatable base, thereby preventing spontaneous rotation of the screw and advancement of the movable elevator that can cause the applicable product to be propelled at undesirable times. Thus, the feedback flaps and feedback struts also serve as an anti-floating mechanism.

The screw-based dispenser further comprises an elevator locking mechanism that prevents the problem of "up-elevator." The locking mechanism includes a circumferential convex protrusion on the screw, and a concave circumferential depression on the portion of the movable elevator that engages with the screw to receive the convex protrusion. Because the convex protrusion on the screw is at the same axial distance above the securing ring for the entire circumference of the screw, rather than staggered as the thread of the screw is, the convex protrusion on the screw when engaged with the concave depression on the movable elevator prevents the movable elevator from rotating up the thread of the screw in the axial direction. In order for the movable elevator to rotate up the thread of the screw in the axial direction, enough force must be applied to the rotatable base to cause the convex protrusion on the screw to slip up and out of the concave depression on the movable elevator, freeing the movable elevator to rotate up the thread of the screw. During transportation of the screw-based dispensers, insufficient force acts on the rotatable base to free the movable elevator. As such, the elevator locking mechanism provides resistance to spontaneous axial movement of the elevator toward the second end of the threaded screw. However, due to the convex and concave shape of the locking mechanism, a user need apply only minimal effort in turning the rotatable base in order to free the movable elevator and, ultimately, dispense the applicable product. Alternate structures of elevator locking mechanisms that initially impede progress of a movable elevator until a threshold force is applied are within the scope of the present invention.

The screw-based dispenser further comprises a elevator retention mechanism that prevents the screw from becoming disassembled from the movable elevator and the cylindrical outer casing. The elevator retention mechanism includes a stop protrusion at the end of the screw opposite the rotatable base. The stop protrusion is formed by undercutting the screw and extends outwardly in a direction perpendicular to the axis of the screw to a distance greater than the radius of the central opening of the movable elevator through which the screw is inserted. When the movable elevator is rotated up the screw, the stop protrusion prevents the movable elevator from rotating off the end of the screw by coming into contact with the engagement wall of the movable elevator, which extends upwardly from the central opening of the movable elevator.

DETAILED DESCRIPTION OF THE PREFERRED EMBODIMENTS

Figure 1:
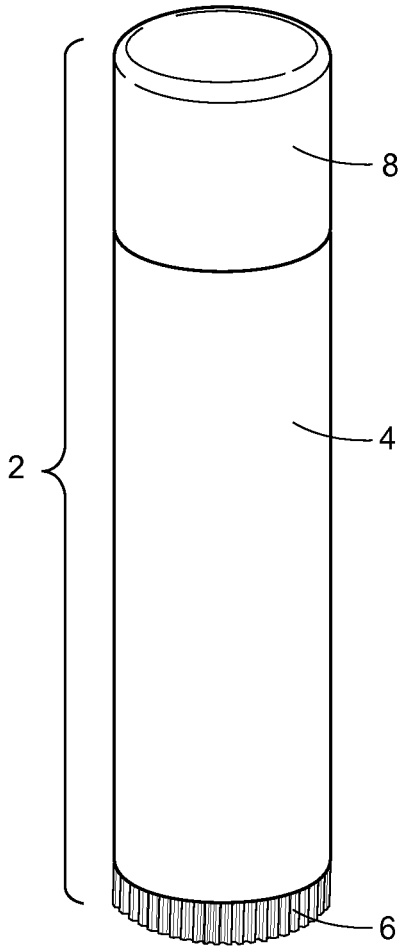
FIG. 1 is a perspective view of a screw-based dispenser with the cap closed.

FIG. 1 illustrates a capped screw-based dispenser 2. The cylindrical outer casing 4, in which the applicable product is contained, is capped by a cap 8 at its dispensing end. The cap prevents the applicable product from being inadvertently applied when the screw-based dispenser is not being used. A circumferential portion of the cap 8 overlaps the cylindrical outer casing 4 such that friction secures the cap 8 to the cylindrical outer casing 4. The cylindrical outer casing 4 is adjacent at its other end to a rotatable base 6. The rotatable base 6 rotates perpendicular to the axis of the cylindrical outer casing 4. The rotatable base 6 may have a plurality of grooves aligned parallel to the axis of the cylindrical outer housing, or other friction-increasing depressions or protrusions, in order to facilitate turning the rotatable base.

Figure 2:
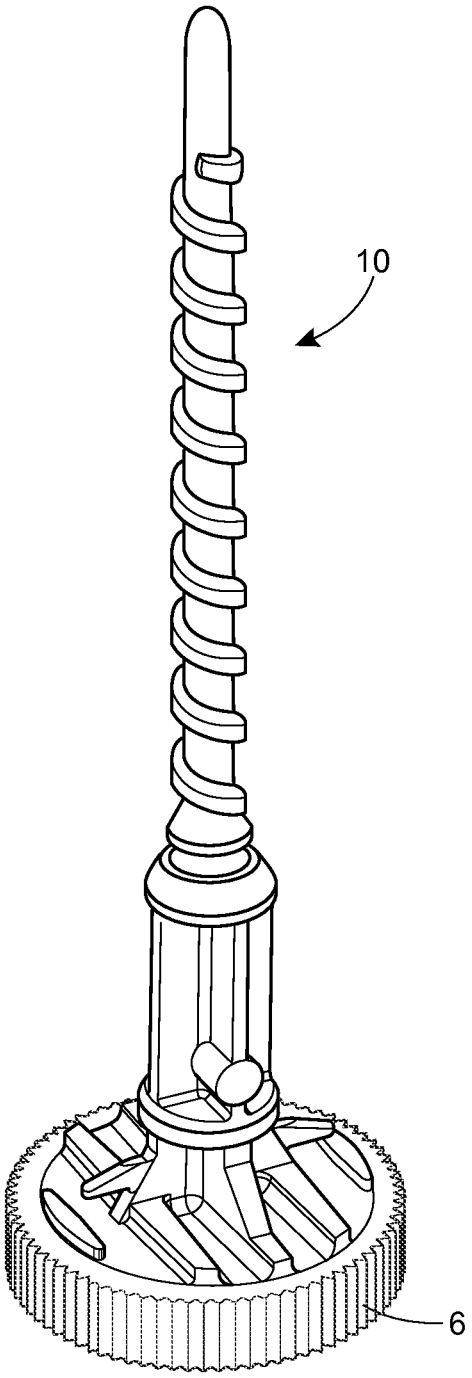
FIG. 2 is a perspective view of the screw and rotatable base.

FIG. 2 is perspective view of the rotatable base 6 and the screw 10 extending perpendicularly from the rotatable base 6 in the direction that, when the screw-based dispenser is assembled, the cylindrical outer casing 4 would be disposed.

Figure 3:
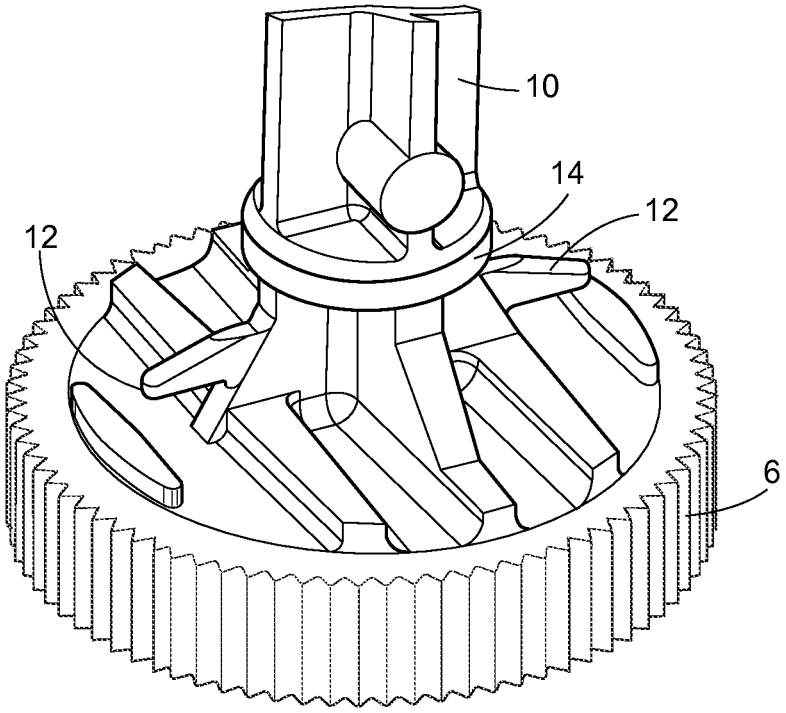
FIG. 3 is an enlarged view of the rotatable base and lower portion of the screw illustrating the feedback flaps and the securing ring.

FIG. 3 is a an enlarged view of the rotatable base 6 and lower portion of the screw 10. If the rotatable base 6 and screw 10 are oriented such that the rotatable base 6 is below the screw 10, then at least two feedback flaps 12 extend outward from the axis of the screw just above the location where the rotatable base connects to the screw 10. The feedback flaps 12 are diametrically opposed to one another. The feedback flaps 12 must be long enough to come into contact with the feedback struts 22 (see FIG. 5) of the cylindrical outer casing 4 and sturdy enough that the contact between the feedback flaps 12 and the feedback struts 22 creates a noise and causes enough pressure for a user experience a tactile sensation and for unintentional rotation of the rotatable base 6 to be prevented. However, the feedback flaps 12 must not be so sturdy that the contact between the feedback flaps 12 and the feedback struts 22 prevents a user from turning the rotatable base 6.

If the rotatable base 6 and screw 10 are oriented such that the rotatable base 6 is below the screw 10, then above the feedback flaps 12 is a securing ring 14. The securing ring 14 protrudes circumferentially from the screw. The purpose of the securing ring is to retain the screw 10 within the cylindrical outer casing 4.

Figure 4:
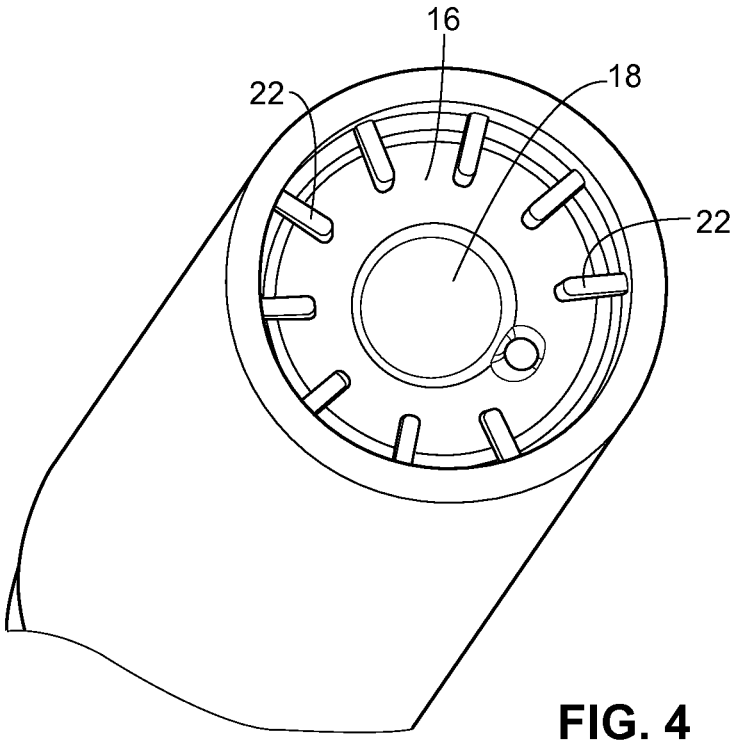
FIG. 4 is an enlarged view of the non-dispensing end of the cylindrical outer casing into which the screw is inserted and which is ultimately adjacent to the rotatable base, illustrating the diametrically opposed feedback struts and center hole.

FIG. 4 is an enlarged view of the non-dispensing end 16 of the cylindrical outer casing 4 into which the screw 10 is inserted, which is ultimately adjacent to the rotatable base 6. In the center of the non-dispensing end 16 of the cylindrical outer casing 4 is a hole 18. The screw 10 is inserted through the hole 18. Once the securing has passed through the hole 18, contact between the securing ring 14 and the internal portion of the non-dispensing end 16 of the cylindrical outer casing 4 secure the screw 10 within the cylindrical outer casing 4.

FIG. 4 further illustrates the feedback struts 22 disposed on the internal portion of the non-dispensing end 16 of the cylindrical outer casing 4. The feedback struts 22 each extend from the outer edge of the non-dispensing end 16 of the cylindrical outer casing 4 toward the hole 18 at the center of the cylindrical outer casing 4. Most of the feedback struts 22 are diametrically opposed to one another. The benefit of having diametrically opposed feedback struts 22 is that the noise and tactile sensation generated when the feedback struts 22 come into contact with the feedback flaps 12 when the rotatable base 6 is turned relative to the cylindrical outer casing 4 is amplified. As a result, a user of the screw-based dispenser 2 receives tactile and auditory feedback indicative of the elevator moving axially relative to the rotatable base 6, thereby propelling product forward (toward the open end of the barrel) or repelling product back into the barrel. Additionally, contact between the feedback struts 22 and the feedback flaps 12 creates sufficient resistance to prevent unintentional rotation of the rotatable base, thereby preventing spontaneous rotation of the screw and advancement of the movable elevator that can cause the applicable product be inadvertently propelled (which phenomenon is sometimes referred to in the art as "floating" or "floating up"). Thus, the feedback struts 22 and feedback flaps 12 prevent the issue of floating. When necessary for manufacturing purposes, an odd number of feedback struts 22 may be used, such that one feedback strut 22 does not have another feedback strut 22 diametrically opposed to it.

Figure 5:
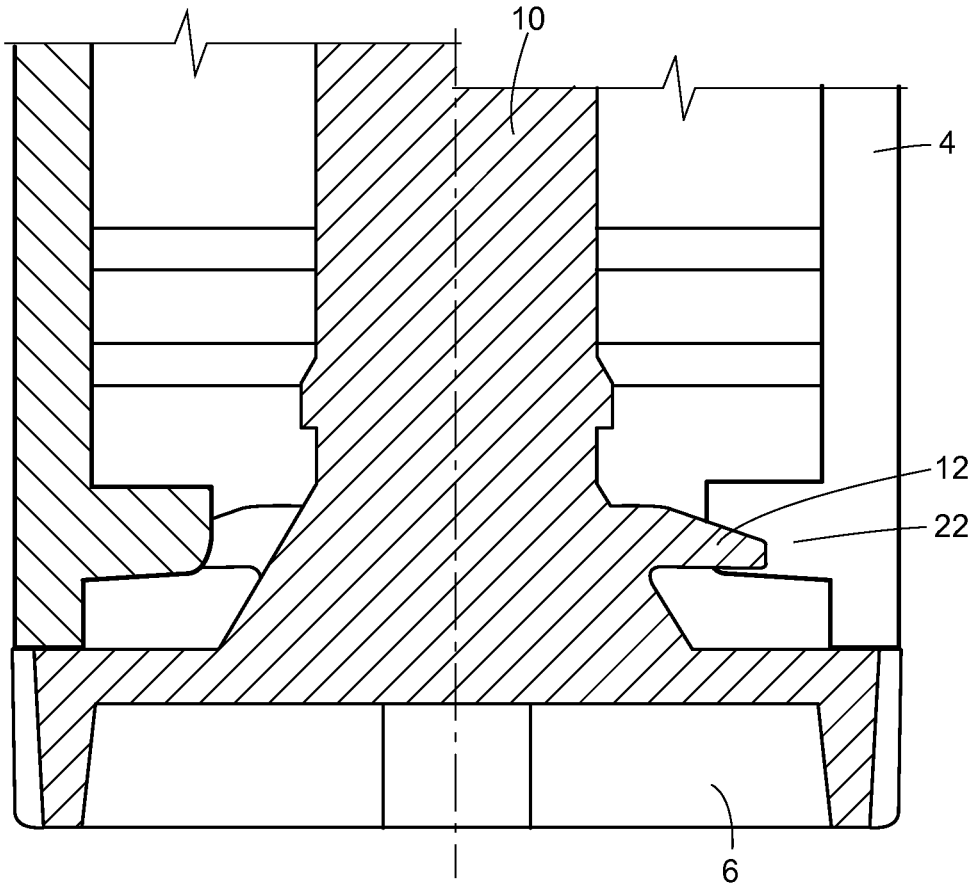
FIG. 5 is a cross-sectional view of the non-dispensing end of the cylindrical casing engaged with the rotatable base and screw, illustrating the contact between the diametrically opposed feedback flaps of the screw and the diametrically opposed feedback struts on the non-dispensing end of the cylindrical outer casing.

FIG. 5 is a cross-sectional view of the non-dispensing end 16 of the cylindrical outer casing 4 engaged with the rotatable base 6 and the screw 10. The screw 10 and the securing ring 14 have already passed through the hole 18 (not pictured). The rotatable base 6 is now adjacent to the outer portion of the non-dispensing end 16. When the rotatable base 6 is turned, the diametrically opposed feedback flaps 12 of the screw 10 come into contact with the diametrically opposed feedback struts 22 of the non-dispensing end 16 of the cylindrical outer casing 4, causing the sensory feedback previously described and preventing inadvertent propelling of the applicable product.

Figure 6:
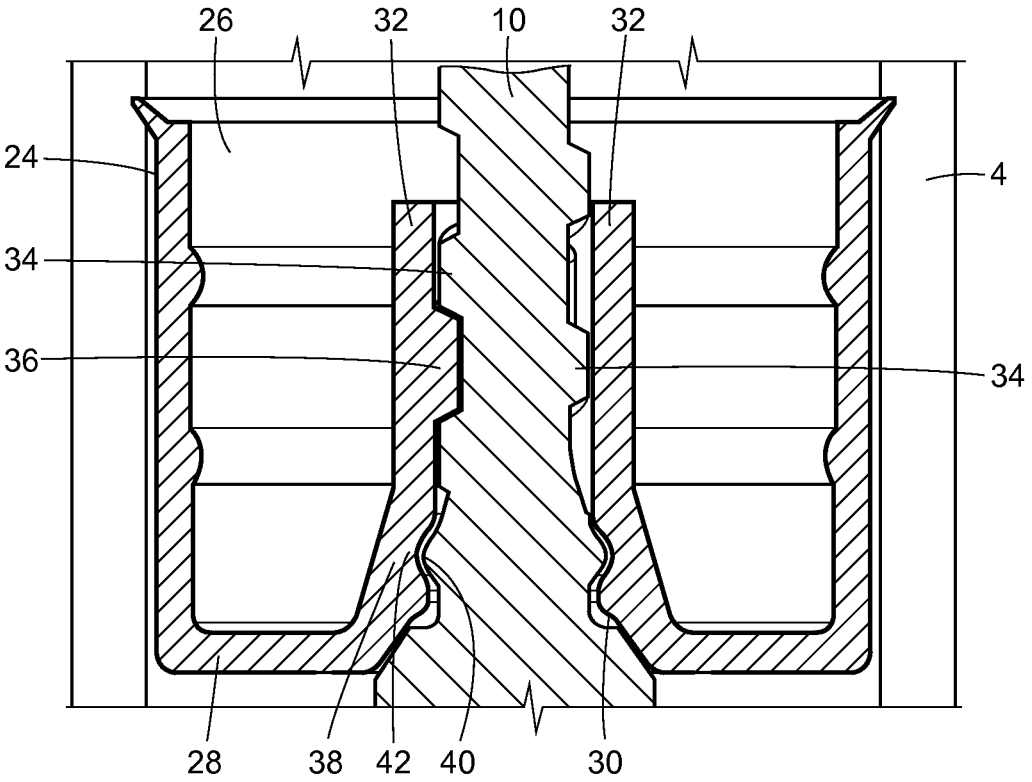
FIG. 6 is an enlarged view of the of the lower portion of the screw engaged with the movable elevator, illustrating the locking mechanism that prevents "up-elevator."

FIG. 6 is an enlarged view of the lower portion of the screw 10 engaged with the movable elevator 24. The movable elevator 24 is substantially cylindrical with an open top end 26 and a mostly closed bottom end 28. The movable elevator 24 has an outer diameter just less than the diameter of the cylindrical outer casing 4. This is desirable because applicable product is placed above the movable elevator 24 within the cylindrical outer casing 4 when screw-based dispenser 2 is in its upright position. If the outer diameter of the movable elevator 24 is too much smaller than the inner diameter of the cylindrical outer casing 4, at least some applicable product spills over the edge of the movable elevator 24 and is therefore not properly dispensed.

The screw 10 is inserted into the movable elevator 24 at its axis. The bottom end 28 of the movable elevator 24 has a central opening 30 disposed at its axis. An engagement wall 32 of the movable elevator 24 extends directly upward from the portion of bottom end 28 closest to the central opening 30. The upper portion of the engagement wall 32 has a wall thread 36. The screw thread 34 engages with the wall thread 36, such that the screw 10 and the movable elevator 24 are operatively connected. Under the proper conditions, rotating the screw 10 causes the movable elevator 24 to spiral up or down the screw thread 34 of the screw 10.

Below the wall thread 36 on the engagement wall 32 is a locking mechanism 38 that prevents the issue of up-elevator. The locking mechanism 38 consists of a shallow convex protrusion 40 on the screw running the entire circumference of the screw 10 at a consistent axial height above the securing ring 14 and a shallow concave depression 42 on the engagement wall 32 running the entire circumference of the engagement wall 32 at a consistent axial height above the bottom end 28 of the movable elevator 24. When the convex protrusion 40 on the screw is engaged with the concave depression 42, the movable elevator 24 is unable to spiral axially up the screw thread 34 because neither the convex protrusion 40 or concave depression 42 is staggered like the screw thread 34 or wall thread 36. However, due to the shallow nature and convex/concave shape of the locking mechanism 38, relatively little force is needed to cause the concave depression 42 to scape up and over the convex protrusion 40. Turning the rotatable base 6 causes the screw 10 to rotate, which in turn causes an upward force to be imparted from the screw thread 34 to the wall thread 36. This force is sufficient to cause the concave depression 42 disposed on the engagement wall 32 to scape up and over the convex protrusion 40. Therefore, the locking mechanism 38 prevents the issue of up-elevator during transportation of the screw-based dispenser 2 but allows a user to easily dispense applicable product during a first use of the screw-based dispenser 2 by turning the rotatable base 6. Alternate structures of locking mechanism 38 that initially impede progress of movable elevator 24 until a threshold force is applied are within the scope of the present invention.

Figure 7:
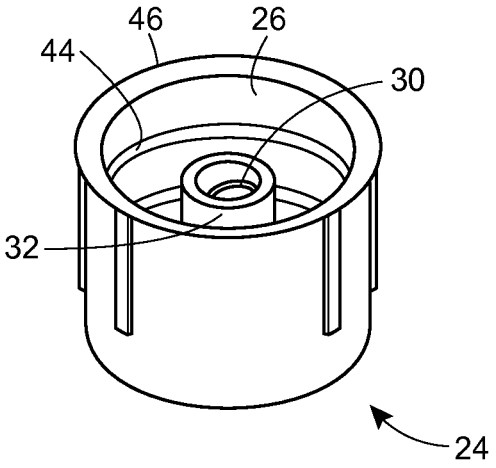
FIG. 7 is a perspective view of the movable elevator.

FIG. 7 a perspective view of the movable elevator 24. The central opening 30 and the engagement wall 32 of the movable elevator are visible through the open top end 26 of the movable elevator 24. Internal grooves 44 are disposed on the outer wall 46 of the movable elevator 24. The internal grooves serve to retain the applicable product within the moveable elevator 24 when the screw-based dispenser 2 is not in an upright position.

Figure 8:
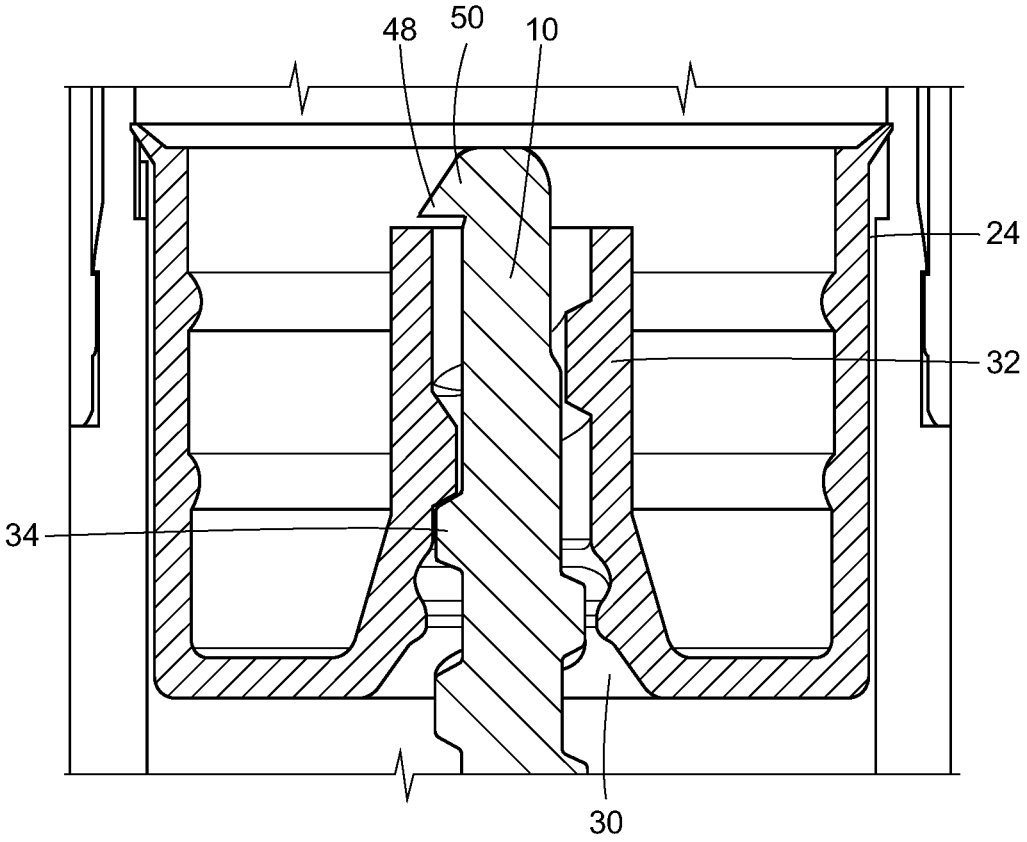
FIG. 8 is an enlarged view of the upper portion of the screw engaged with the movable elevator, illustrating the elevator retention mechanism.

FIG. 8 is an enlarged view of the upper portion of the screw 10 engaged with the movable elevator 24, illustrating the elevator retention mechanism 50. The elevator retention mechanism 50 includes a stop protrusion 48. The stop protrusion 48 is disposed on the end of the screw 10 that is not adjacent to the rotatable base 6. The screw 10 is undercut to form the stop protrusion 48. The stop protrusion 48 extends outwardly from the axis of the screw 10 to a distance greater than the radius of the central opening 30 of the movable elevator 24. The elevator retention mechanism 50 prevents the movable elevator 24 from rotating up and off the screw thread 34 by coming into contact with the engagement wall 32 of the movable elevator 24.

What is claimed is:

1. A screw-based dispenser comprising:

a cylindrical outer casing having a center hole;

a threaded screw having a first end and a second end, where the threaded screw is connected at the first end to a base;

a substantially cylindrical movable elevator having a bottom end upon which an applicable product may be placed, a central opening through which the threaded screw is inserted and an engagement wall that extends directly upward from a portion of the bottom end closest to the central opening and is operably engaged with the threaded screw within the cylindrical outer casing; and an elevator locking mechanism disposed a predetermined distance from the first end of the threaded screw, the elevator locking mechanism providing resistance to spontaneous axial movement of the elevator toward the second end of the threaded screw, wherein the elevator locking mechanism comprises a convex protrusion disposed on the threaded screw and comprises a concave depression disposed in the engagement wall of the movable elevator.

2. The screw-based dispenser of claim 1 wherein the convex protrusion is disposed on the threaded screw and extends around the entire circumference of the threaded screw and the concave depression disposed in the engagement wall of the movable elevator extends around the entire circumference of the engagement wall of the movable elevator.

3. The screw-based dispenser of claim 1, wherein movable elevator further comprises an outer wall having internal grooves to retain an applicable product within the movable elevator.

* * * * *